US006334728B1

(12) United States Patent
Suzuki

(10) Patent No.: US 6,334,728 B1
(45) Date of Patent: Jan. 1, 2002

(54) DOUBLE-CHUCK MECHANICAL PENCIL

(75) Inventor: Takahiko Suzuki, Kawagoe (JP)

(73) Assignee: Kotobuki & Co.,Ltd., Kyoto (JP)

( * ) Notice: Subject to any disclaimer, the term of this patent is extended or adjusted under 35 U.S.C. 154(b) by 0 days.

(21) Appl. No.: 09/680,329

(22) Filed: Oct. 6, 2000

(30) Foreign Application Priority Data

Oct. 7, 1999 (JP) ..... 11-286353
Jul. 7, 2000 (JP) ..... 12-206231

(51) Int. Cl.[7] ..... B43K 21/22; B43K 21/16
(52) U.S. Cl. ..... 401/67; 401/89; 401/92
(58) Field of Search ..... 401/67, 89, 90, 401/92, 93, 94

(56) References Cited

U.S. PATENT DOCUMENTS 5,947,620 A * 9/1999 Kageyama et al. ..... 401/67
6,039,484 A * 3/2000 Kageyama et al. ..... 401/67 X
6,039,485 A * 3/2000 Kageyama et al. ..... 401/67

* cited by examiner

*Primary Examiner*—Gregory L. Huson
*Assistant Examiner*—Kathleen J. Prunner
(74) *Attorney, Agent, or Firm*—McGinn & Gibb, PLLC

(57) ABSTRACT

A double-chuck mechanical pencil includes a barrel having an open front end part, an inner tube inserted in the barrel, a front chuck having a first chucking head and supported on a front end part of the inner tube with a front end part of the first chucking head projected outside through the open front end part of the barrel, a feed chuck having a second chucking head and inserted in the inner tube, a chuck ring put on the second chucking head of the feed chuck, and an axially movable tank serving as both a member to contain spare leads and a member to push the feed chuck.

20 Claims, 7 Drawing Sheets

DOUBLE-CHUCK MECHANICAL PENCIL

BACKGROUND OF THE INVENTION

1. Field of the Invention

The present invention relates to a double-chuck mechanical pencil and, more particularly, to a double-chuck mechanical pencil provided with a front chuck for holding a front portion of a lead and a feed chuck disposed behind the front chuck to feed the lead.

2. Description of the Related Art

A double-chuck mechanical pencil is very excellent in reducing the lead loss, i.e., the residual lead that cannot be used. A Conventional double-chuck mechanical pencil has a front chuck, and a feed chuck connected directly to a lead tank. Therefore, if the lead tank is rotated by some cause in a state where a lead is held by both the front chuck and the feed chuck, it is possible that the lead is twisted and broken.

In the double-chuck mechanical pencil, the chucking head of the front chuck is inserted in a forward open end of a barrel. The inside diameter of the forward open end of the barrel is necessarily greater than the outside diameter of the chucking head to ensure the smooth axial movement of the front chuck. Consequently, there is the possibility that the front chuck shakes laterally in the barrel. Therefore, when a color lead more fragile than a black lead is used, the color lead, sometimes, is shook laterally in the barrel and damaged.

SUMMARY OF THE INVENTION

The present invention has been made to overcome such disadvantages in the conventional double-chuck mechanical pencil and it is therefore an object of the present invention to provide a double-chuck mechanical pencil having a feed chuck which may not be turned by a lead tank even if the lead tank is turned by some cause.

Another object of the present invention is to provide a double-chuck mechanical pencil having a front chuck that cannot be shook laterally in a barrel.

According to a first aspect of the present invention, a double-chuck mechanical pencil includes a barrel having an open front end part, an inner tube inserted in the barrel, a front chuck having a first chucking head and supported on a front end part of the inner tube with a forward end part of the first chucking head projected outside through the open front end part of the barrel, a feed chuck having a second chucking head inserted in the inner tube, a chuck ring put on the second chucking head of the feed chuck, and a lead tank disposed behind the feed chuck, separated from the feed chuck, capable of axial movement, containing leads and capable of pressing the feed chuck to operate the feed chuck when pressure is applied to the back end thereof.

Preferably, the double-chuck mechanical pencil further includes a first spring interposed between the barrel and the inner tube so as to bias the inner tube continuously backward, a first retaining mechanism associated with the barrel and the inner tube to retain the inner tube on the barrel against the resilience of the first spring, a sleeve inserted in the inner tube and receiving the feed chuck therein with the second chucking head on which the chuck ring is loosely put projecting from the front end of the sleeve, a second spring interposed between the sleeve and the feed chuck to bias the feed chuck backward continuously, a stopping tube disposed behind the sleeve, a second retaining mechanism associated with the inner tube and the stopping tube to retain the stopping tube on the inner tube, and a pushing or pressing member attached to the back end of the lead tank, wherein a front end part of the lead tank is inserted in the stopping tube.

Preferably, the first retaining mechanism includes the barrel provided with axial slots and the inner tube provided with first projections respectively engaging the slots of the barrel, and the second retaining mechanism includes the inner tube provided with slots and the stopping tube provided with second projections respectively engaging the slots of the inner tube.

Preferably, the inner tube has an elastic part capable of axially expanding and contracting to adjust the position of the first projection relative to the slot of the barrel when the respective positions of the slot and the first projection do not coincide.

Preferably, the open front end part of the barrel has a front section having an increased inside diameter, the first chucking head of the front chuck has a plurality of grasping parts each having an angular middle portion and sloping portions having sloping outer surfaces sloping down forward and backward, respectively, from the angular middle portion, and the angular middle portions of the first chucking head of the front chuck lie in the front section having an increased inside diameter of the barrel while the double-chuck mechanical pencil is being used for writing.

Preferably, a metal sleeve having a bore having a front section of an increased inside diameter is fitted in the open front end part of the barrel, the first chucking head of the front chuck has a plurality of grasping parts each having an angular middle portion and sloping portions having sloping outer surfaces sloping down forward and backward, respectively, from the angular middle portion, and the angular portions of the first chucking head of the front chuck lie in the front section having an increased inside diameter of the metal sleeve while the double-chuck mechanical pencil is being used for writing.

Preferably, the metal sleeve is provided with an annular ridge, the open front end part of the barrel is provided with an annular groove, and the metal sleeve is held in the barrel with the annular ridge thereof fitted in the annular groove of the barrel.

Preferably, the double-chuck mechanical pencil further includes a lead holding member interposed between the feed chuck and the front chuck in alignment with the center axis of a lead supply path.

Preferably, the barrel consists of a barrel body and a tip cap attached to a front end part of the barrel body.

Preferably, at least either the feed chuck or the lead tank is provided with an auxiliary pressing means useful for pressing the feed chuck.

Preferably, the auxiliary pressing means is placed on a back end part of the feed chuck or on a front end part of the lead tank.

Preferably, the auxiliary pressing means is a flange.

Preferably, the double-chuck mechanical pencil further includes a third spring capable of exerting a resilient force lower than those that are exerted by the first and the second spring and interposed between the lead tank and the stopping tube.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
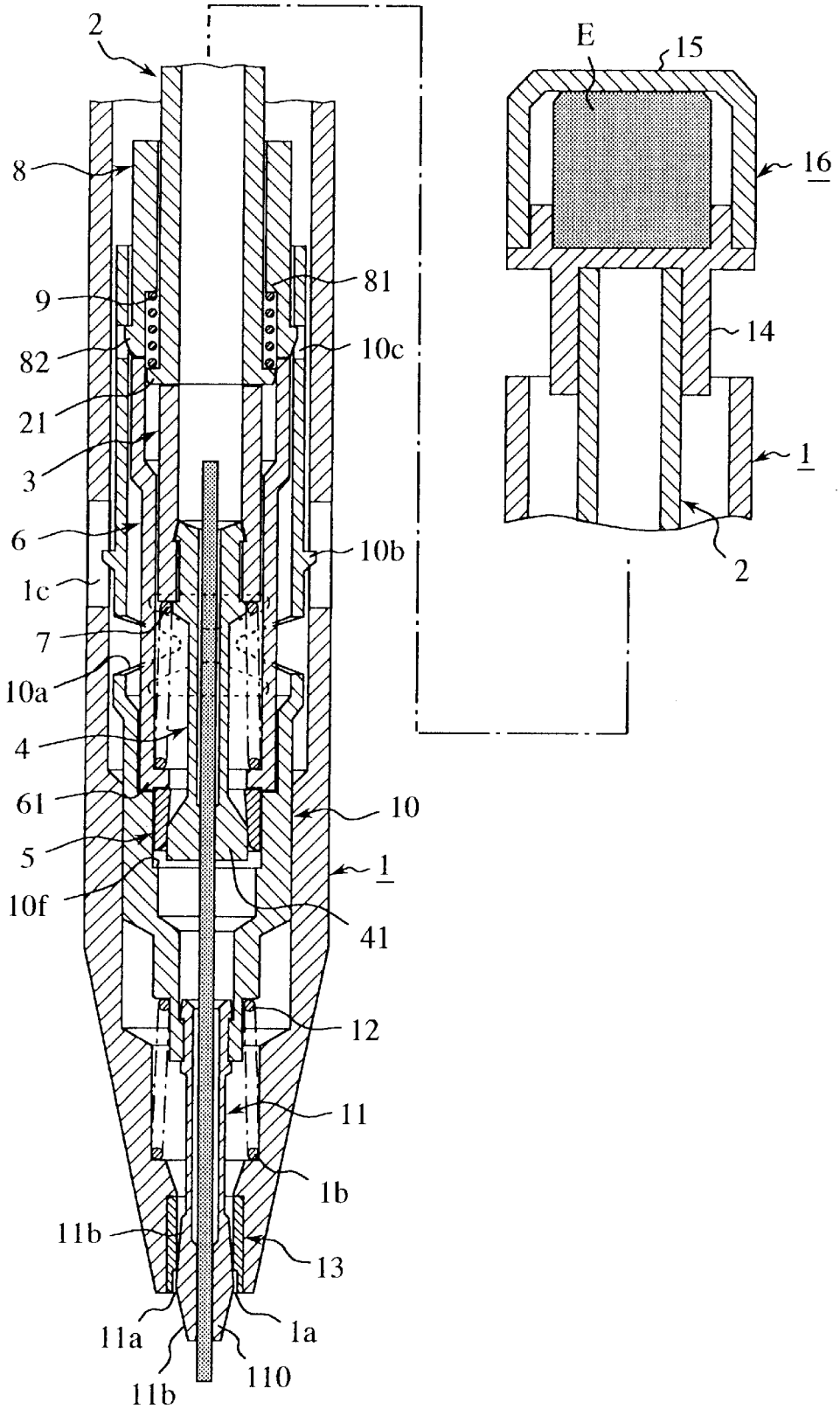
FIG. 1 is longitudinal sectional view, partly omitted, of a double-chuck mechanical pencil in a first embodiment according to the present invention.

FIGS. 1 to 4 show a double-chuck mechanical pencil in a first embodiment according to the present invention. The double-chuck mechanical pencil has a barrel 1 of a unitary type made of a synthetic resin and having an open front end part 1*a*, an inner tube 10 inserted in the barrel 1, a front chuck 11 having a chucking head 110 and supported on a front end part of the inner tube 10 so that a front end part thereof projects outside from the open front end part 1*a* of the barrel 1, a sleeve 6 inserted in the inner tube 10, a feed chuck 4 disposed in the inner tube 10, a stopping tube 8 inserted in the inner tube 10 so as to be in contact with the back end of the sleeve 6, a lead tank 2 disposed behind the feed chuck 4 in the barrel 1 so as to be axially movable and isolated from the feed chuck 4, a first cooperating means on the barrel 1 and inner tube 10 for retaining the inner tube 10 on the barrel 1, a second cooperating means on the stopping tube 8 and inner tube 10 for retaining the stopping tube 8 on the inner tube 10, and a pressing member 16 detachably put on a back end part of the lead tank 2.

The feed chuck 4 has a chucking head 41. A chuck ring 5 is loosely put on the chucking head 41. A back end part of the chuck 4 is connected to a chuck connecting member 3 having an inside diameter and an outside diameter substantially equal to those of the lead tank 2. The chuck connecting member 3 may be omitted, and the back end part of the feed chuck 4 may be provided integrally with a tubular part corresponding to the chuck connecting member 3 to reduce the number of parts of the double-chuck mechanical pencil.

A stopping shoulder 10*f* is formed around the inner circumference of the inner tube 10. When the pressing member 16 is pushed to press the lead tank 2 axially forward, the feed chuck 4 is moved forward and the chuck ring 5 is brought into contact with the stopping shoulder 10*f*. Consequently, the feed chuck 4 is released from the chuck ring 5 as the same is moved further forward to feed a lead.

A shoulder 1*b* is formed around the inner circumference of a front end part of the barrel 1 and a first spring 12 is extended between the shoulder 1*b* and the inner tube 10 to bias continuously backward the inner tube 10 which supports the front chuck 11.

An inner flange 61 is formed at the front end of the sleeve 6. A second spring 7 is extended between the inner flange 61 and the chuck connecting member 3 to bias the feed chuck 4 continuously backward. The resilience of the second spring 7 is higher than that of the first spring 12.

The chucking head 110 of the front chuck 11 has a plurality of grasping parts each having an angular middle portion 11*a* and sloping portions 11*b* having sloping outer surfaces sloping down forward and backward, respectively, from the angular middle portion 11*a*.

A front end part of the chucking head 110 projects outside from the open front end part 1*a* of the barrel 1. The grasping parts of the front chuck 11 are unable to open and close smoothly as the front chuck 11 is moved axially if the open front end part 1*a* is not finished accurately in a predetermined inside diameter. If the inside diameter of the open front end part 1*a* is excessively greater than the outside diameter of the chucking head 110, there is the possibility that the front chuck 11 moves radially relative to the barrel 1 and the lead chucked by the front chuck 11 is damaged. In this embodiment, the barrel 1 is formed of a synthetic resin that makes it difficult to form the open front end part 1*a* of the barrel 1 accurately in a predetermined inside diameter.

Figure 4:
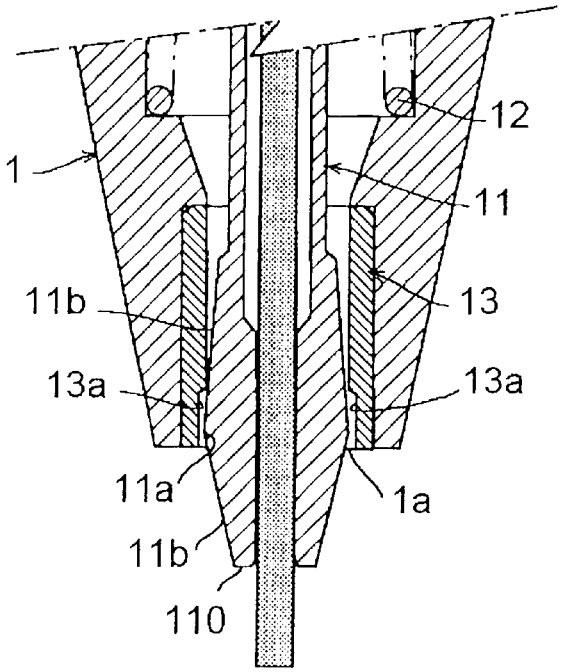
FIG. 4 is an enlarged longitudinal sectional view of a front end part of the double-chuck mechanical pencil shown in FIG. 1.

In the first embodiment, a metal sleeve 13 that can be easily formed in accurate dimensions is fitted in the open front end part 1*a*, and the chucking head 110 of the front chuck 11 is inserted in the bore of the metal sleeve 13 to ensure the smooth axial movement of the front chuck 11 and to prevent the chucking head 110 from lateral shaking. More specifically, the bore of the metal sleeve 13 has a front end section 13*a* of an increased diameter as best shown in FIG. 4. While the double-chuck mechanical pencil is being used for writing, the angular middle portions 11*a* of the chucking head 110 of the front chuck 11 are in the front end section 13*a* of the bore of the metal sleeve 13. The front end section 13*a* of an increased diameter is formed in the bore of the metal sleeve 13 and the angular middle portions 1*a* of the chucking head 110 of the front chuck 11 are in the front end section 13*a* while the double-chuck mechanical pencil is being used for writing, so that when a lateral force acts on the chucking head 110 of the front chuck 11, the angular middle portions 11a come into contact with the circumference of the bore of the metal sleeve 13 to thereby prevent the front chuck from lateral shaking.

The first cooperating means includes a plurality of projections 10*b* formed around the outer circumference of the inner tube 10, and axially elongated slots 1*c* disposed around the periphery of the barrel 1 and corresponding in number to the projections 10*b*. The projections 10*b* engage the slots 1*c* to allow the inner tube 10 to move axially relative to the barrel 1 and to restrain the inner tube 10 from turning relative to the barrel 1. When combining the inner tube 10 with the barrel 1, the inner tube 10 is inserted through the open back end of the barrel 1 into the barrel 1. The front ends of the projections 10*b* are beveled to facilitate inserting the projections 10*b* of the inner tube 10 into the barrel 1. When forcing the inner tube 10 into the barrel 1, the projections 10*b* are pressed radially inward by the wall of the barrel 1. Each projection 10*b* has a vertical back end, so that the projections 10*b* fitted in the slots 1*c* are able to engage the back edges of the slots 1*c* securely. In a state where the front chuck 11 is not holding any lead, the inner tube 10 is biased backward by the first spring 12 so that the vertical back ends of the projections 10*b* are pressed against the back edges of the slots 1*c*.

Problems arise if the slots 1*c* and the projections 10*b* are not formed at the correct positions accurately when forming the barrel 1 and the inner tube 10. If the projections 10*b* are formed at positions at a considerable distance backward from the correct positions, the first spring 12 is compressed when the inner tube 10 is inserted in the barrel 1 and the projections 10*b* are engaged with the back ends of the slots 1*c*. Consequently, the front chuck 11 remains open at all times even if the pressing member 16 is not pushed, the front chuck 11 is unable to hold the lead securely and the lead may possibly fall out. If the projections 10*b* are formed at positions at a considerable distance forward from the correct positions, the front chuck 11 is pulled backward together with the inner tube 10 when the inner tube 10 is inserted in the barrel 1 and the projections 10*b* are engaged with the back ends of the slots 1*c*. Consequently, the front chuck 11 remains closed at all times even if the pressing member 16 is pushed, and is unable to receive the lead fed by the feed chuck 4, and the first spring 12 is unable to exert effective resilience and rattles in the barrel 1 when the barrel 1 is shook.

Figure 2:
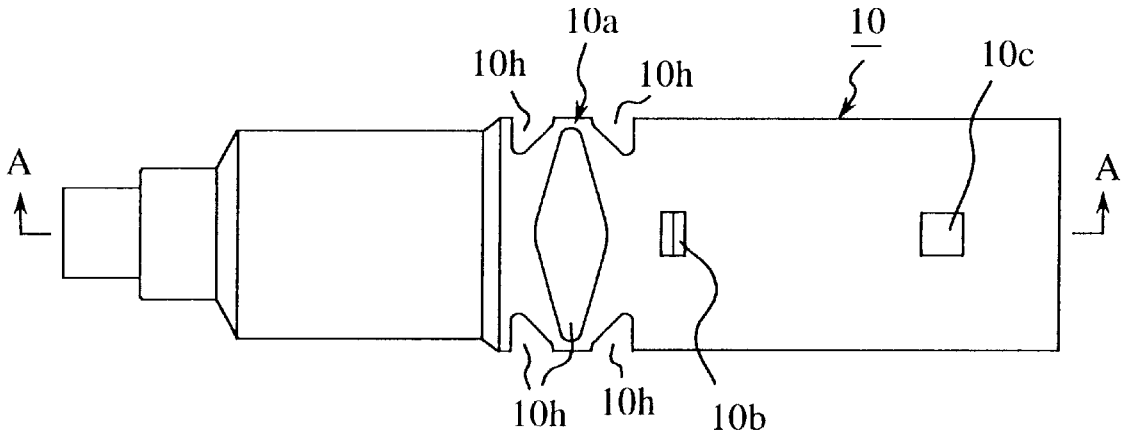
FIG. 2 is a front elevation of an inner tube included in the double-chuck mechanical pencil shown in FIG. 1.
Figure 3:
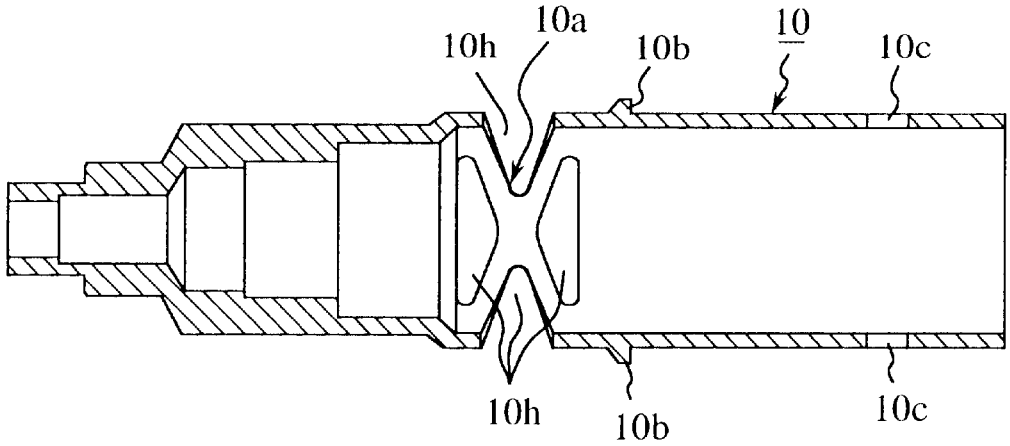
FIG. 3 is a sectional view taken on line A—A in FIG. 2.

To avoid such problems, the double-chuck mechanical pencil in the first embodiment is provided with an adjusting structure capable of compensating for the positional error of the projections 10*b* or the slots 1*c*. As shown in FIGS. 2 and 3, the adjusting structure has an elastic part 10*a* capable of axial expansion and contraction and having a plurality of circumferential cutouts 10*h* formed in a substantially middle portion with respect to length of the inner tube 10. The axially elastic part 10*a* expands or contracts to compensate for the positional errors in the projections 10*b* or the slots 1*c* when the projections 10*b* or the slots 1*c* are not formed accurately at the predetermined positions.

The second cooperating means includes spaced apart slots 10*c* formed around a back end part of the inner tube 10 and spaced apart projections 82 formed around the outer circumference of a front end part of the stopping tube 8 and corresponding in number to the slots 10*c* of the inner tube 10. The projections 82 of the stopping tube 8 are engaged with the slots 10*c* of the inner tube 10 to retain the stopping tube 8 on the inner tube 10. The front ends of the projections 82 of the stopping tube 8, similarly to those of the projections 10*b* of the inner tube 10, are beveled to facilitate inserting the projections 82 of the stopping tube 8 into the inner tube 10. Each projection 82 has a vertical back end, so that the projections 82 fitted in the slots 10*c* are able to engage the back edges of the slots 10*c* securely.

The pressing member 16 comprises an eraser holder 14 holding an eraser E and detachably attached to a back end part of the lead tank 2, and a cap 15 removably put on the eraser holder 14.

The operation of the double-chuck mechanical pencil constructed as described above will be described hereinafter. When starting writing with the double-chuck mechanical pencil, the pressing member 16 is pushed against the resilience of the second spring 7. Pressure applied to the pressing member 16 is transmitted through the chuck connecting member 3 to the feed chuck 4 to advance the feed chuck 4. The chuck ring 5 comes into contact with the stopping shoulder 10*f* of the inner tube 10 as the feed chuck 4 is advanced, and the feed chuck 4 is released from the chuck ring 5 and advanced further to feed the lead.

When the pressing member 16 is pushed repeatedly, the lead advances gradually relative to the feed chuck 4 and is fed into the front chuck 11. Eventually, the lead is held by the chucking head 110 of the front chuck 11 with the tip thereof projecting from the tip of the chucking head 110 of the forward chuck 11. Since the metal ring 13 is fitted in the open front end part 1*a* of the barrel 1 to prevent the shaking of the front chuck 11, the lead will not be broken by the front chuck 11 during writing.

When retracting the lead into the barrel 1 after writing, the pressing member 16 is pushed to open the feed chuck 4, pressure is applied to the tip of the lead or the tip of the lead is pressed against a paper sheet to push the lead into the barrel 1.

When it is necessary to disassemble the double-chuck mechanical pencil, the projections 10*b* of the inner tube 10 engaged with the slots 1*c* of the barrel 1 are pushed radially inward so that the projections 10*b* are disengaged from the barrel 1 and the inner tube 10 is pulled out of the barrel 1 with a single motion through the open back end of the barrel 1. The stopping tube 8 can be easily removed from the inner tube 10 by pushing the projections 82 of the stopping tube 8 radially inward so that the projections 82 are disengaged from the slots 10*c* of the inner tube 10.

Even if the lead tank 2 is turned by an erasing operation that turns the eraser E in the eraser holder 14 on a paper sheet in a state where the lead is held by both the feed chuck 4 and the front chuck 11, the turning of the lead tank 2 is never transmitted to the feed chuck 4 and the front chuck 11 and the lead is not twisted to break because the lead tank 2 is isolated from the feed chuck 4.

The pressing member 16 must be pushed to advance the feed chuck 4 when feeding the lead by the feed chuck 4. At least either the feed chuck 4 or the lead tank 2 may be provided with an auxiliary pressing means to push the feed chuck 4 with reliability. In the illustrated example, a flange 21 formed on the front end of the lead tank 2 serves as the auxiliary pressing means. The flange 21 enables the lead tank 2 to push the feed chuck 4 with reliability. When the lead tank 2 is provided with the flange 21, it is preferable to form a shoulder 81 in the inner circumference of the stopping tube 8 and to extend a third spring 9 having a low resilience between the flange 21 of the lead tank 2 and the shoulder 81 of the stopping tube 8 to avoid the free axial movement of the lead tank and the resultant unpleasant noise.

Figure 5:
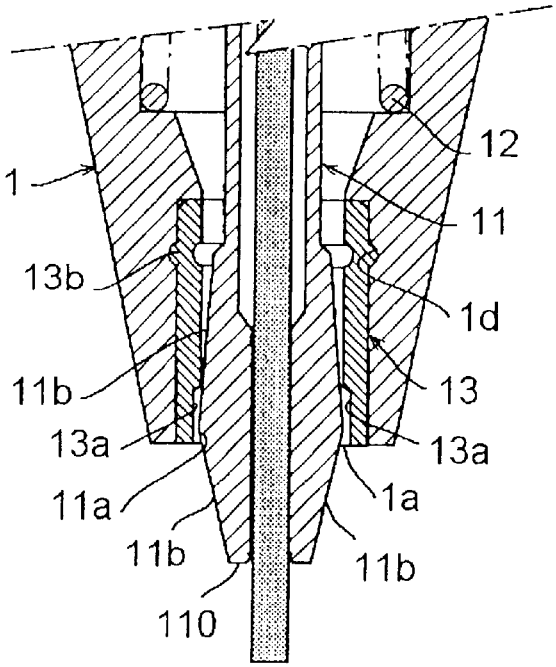
FIG. 5 is an enlarged longitudinal sectional view of a modification of a structure for attaching a stabilizing sleeve to a barrel shown in FIG. 4.

FIG. 5 shows a modification of the double-chuck mechanical pencil shown in FIG. 1. As shown in FIG. 5, the barrel 1 is provided with an annular groove 1*d* in the inner circumference of an open front end part 1*a* thereof and the metal ring 13 is provided with an annular ridge 13*b* on its outer circumference. The metal ring 13 can be easily and surely attached to the barrel 1 by fitting annular ridge 13*b* thereof in the annular groove 1*d* of the open front end part 1*a* of the barrel 1. Thus, the metal ring 13 is held securely in the open front end part 1*a* of the barrel 1. Even if a front chuck 11 included in the double-chuck mechanical pencil is turned by any chance, the outer circumference of the front chuck 11 and the inner circumference of the metal ring 13 do not abrade each other because the metal ring 13 is rotatable.

A double-chuck mechanical pencil in a second embodiment according to the present invention will be described with reference to FIGS. 6 to 10, in which parts like or corresponding to those of the double-chuck mechanical pencil in the first embodiment are denoted by the same reference characters and the description thereof will be omitted to avoid duplication.

The double-chuck mechanical pencil in the second embodiment is substantially the same in construction as the double-chuck mechanical pencil in the first embodiment except that the double-chuck mechanical pencil in the second embodiment includes an inner tube 100 and a stopping tube 800 different from the inner tube 10 and the stopping tube 8 of the first embodiment and is provided with a lead holding member 17 for preventing the free advancement of the lead and the slight backward movement of the lead as the feed chuck 4 moves backward.

The lead holding member 17 is an annular member made of rubber or an elastic synthetic resin. The lead holding member 17 is disposed in a lead feed path in the inner tube 100 coaxially with the center axis of the inner tube 100.

Figure 7:
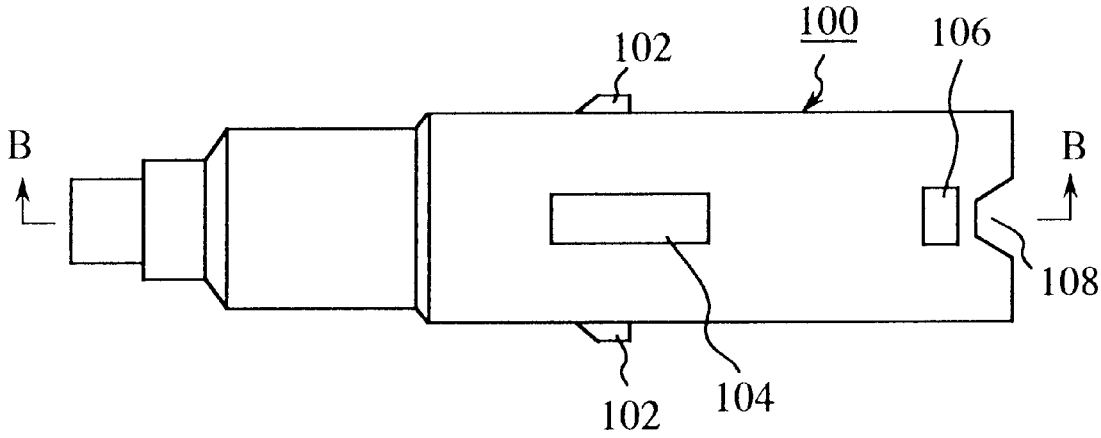
FIG. 7 is a front elevation of an inner tube included in the double-chuck mechanical pencil shown in FIG. 6.
Figure 8:
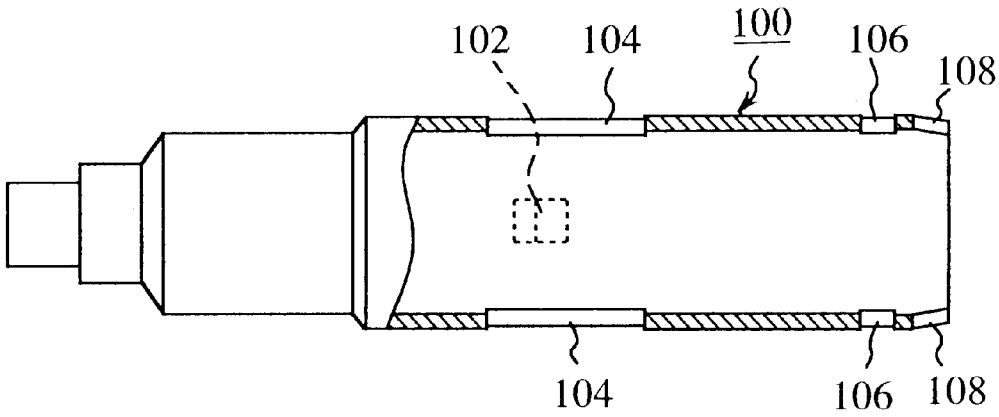
FIG. 8 is a sectional view taken on line B—B in FIG. 7.

As shown in FIGS. 7 and 8, the inner tube 100 is provided with a plurality of projections 102 and a plurality of slots 104 in substantially the middle part with respect to the length thereof. The projections 102 and the slots 104 are arranged alternately. Openings 106 are formed in a back end part of the inner tube 100 in axial alignment with the slots 104. Cutouts 108 are formed in the back edge of the inner tube 100 in axial alignment with the openings 106.

Figure 6:
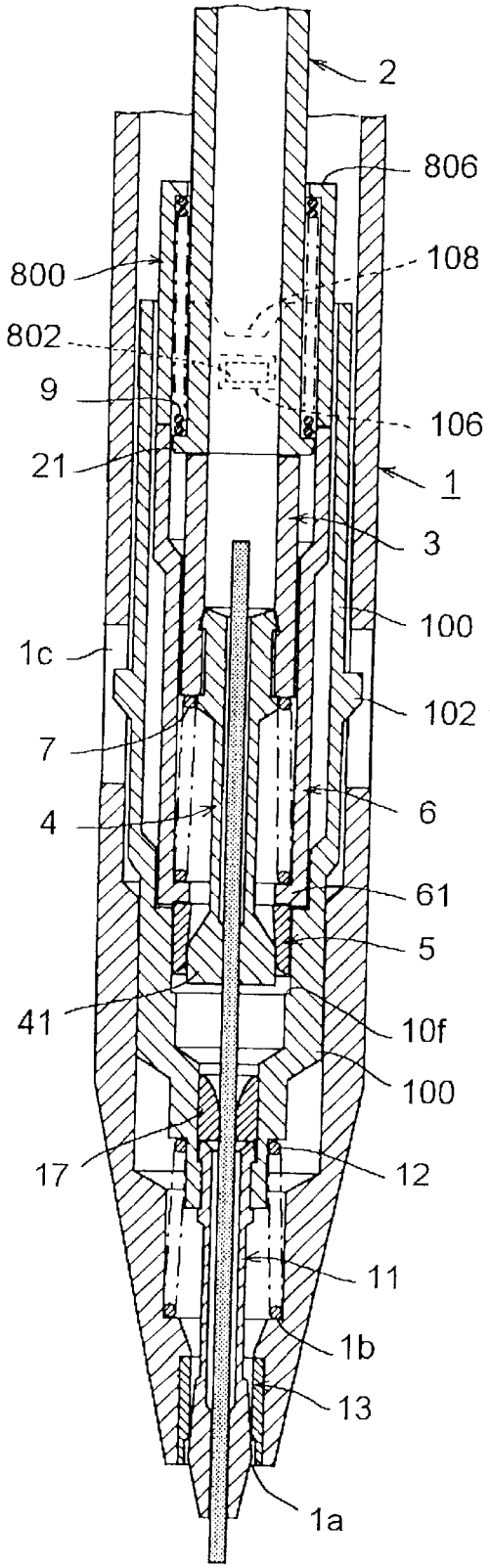
FIG. 6 is a longitudinal sectional view of an essential portion of a double-chuck mechanical pencil in a second embodiment according to the present invention.

As shown in FIG. 6, the inner tube 100 is inserted in a barrel 1 so that the projections 102 are engaged with the slots 1*c* of the barrel 1. Since the inner tube 100 is provided with the projections 102 and the slots 104 in an alternate circumferential arrangement, a portion of the inner tube 100 which is provided with the projections 102 and the slots 104 is elastically deformable. Therefore, the inner tube 100 can be easily inserted in the barrel 1 by elastically deforming the portion of the inner tube 100 which is provided with the projections 102 and the slots 104 so that the projections 102 sink in.

Figure 9:
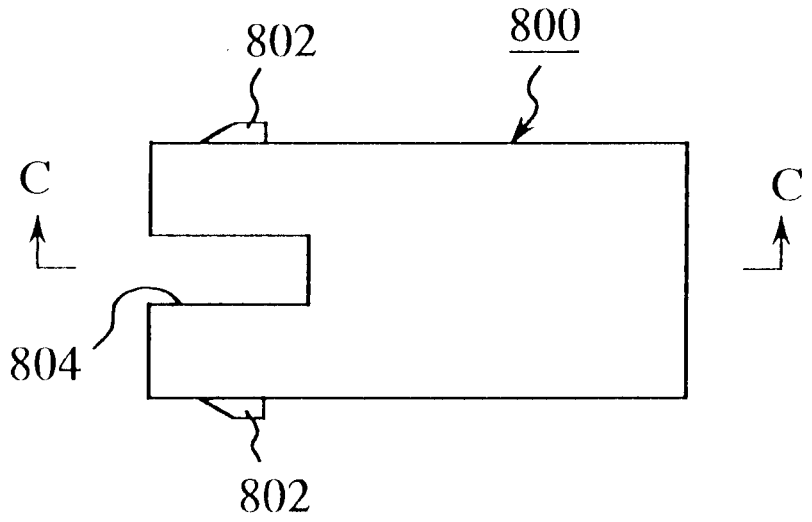
FIG. 9 is a front elevation of a stopping tube included in the double-chuck mechanical pencil shown in FIG. 6.
Figure 10:
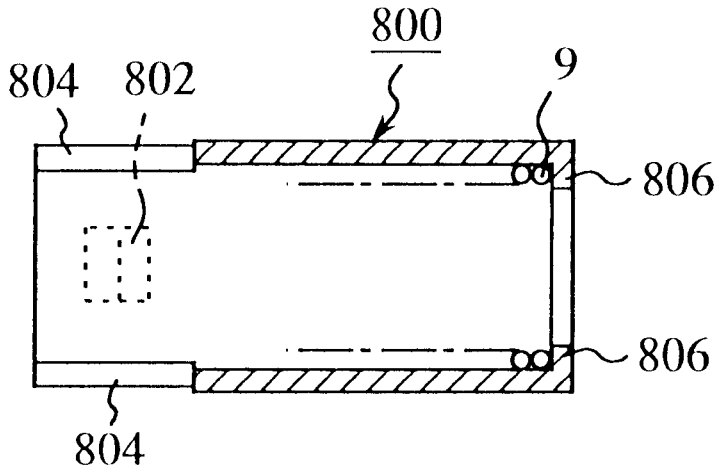
FIG. 10 is a sectional view taken on line C—C in FIG. 9.

As shown in FIGS. 9 and 10, the stopping tube 800 is provided with a plurality of projections 802 and a plurality of slots 804 in an alternate arrangement around a front end portion thereof, and an internal flange 806 on the back end thereof. The projections 802 of the stopping tube 800 are engaged with the opening 106 of the inner tube 100 as indicated by broken lines in FIG. 6. Since the stopping tube 800 is provided, similarly to the inner tube 100, with the projections 802 and the slots 804 in a circumferential alternate arrangement, a portion of the stopping tube 800 which is provided with the projections 802 and the slots 804 is elastically deformable. Therefore, the stopping tube 800 can be easily inserted in the inner tube 100 by elastically deforming the portion of the stopping tube 800 which is provided with the projections 802 and the slots 804 so that the projections 802 sink in.

Since the inner tube 100 is provided with the cutouts 108 in the back edge of the inner tube 100 in axial alignment with the openings 106, the projections 802 of the stopping tube 800 can be guided by the cutouts 108 toward the openings 106 so that the projections 802 can be easily and smoothly engaged with the openings 106.

The spring 9 having a low resilience is extended between the external flange 21 formed on the lead tank 2 and the internal flange 806 of the stopping tube 800 to avoid the free axial movement of the lead tank 2.

The operation of the double-chuck mechanical pencil in the second embodiment is the same as that of the double-chuck mechanical pencil in the first embodiment and hence the description thereof will be omitted.

Figure 11:
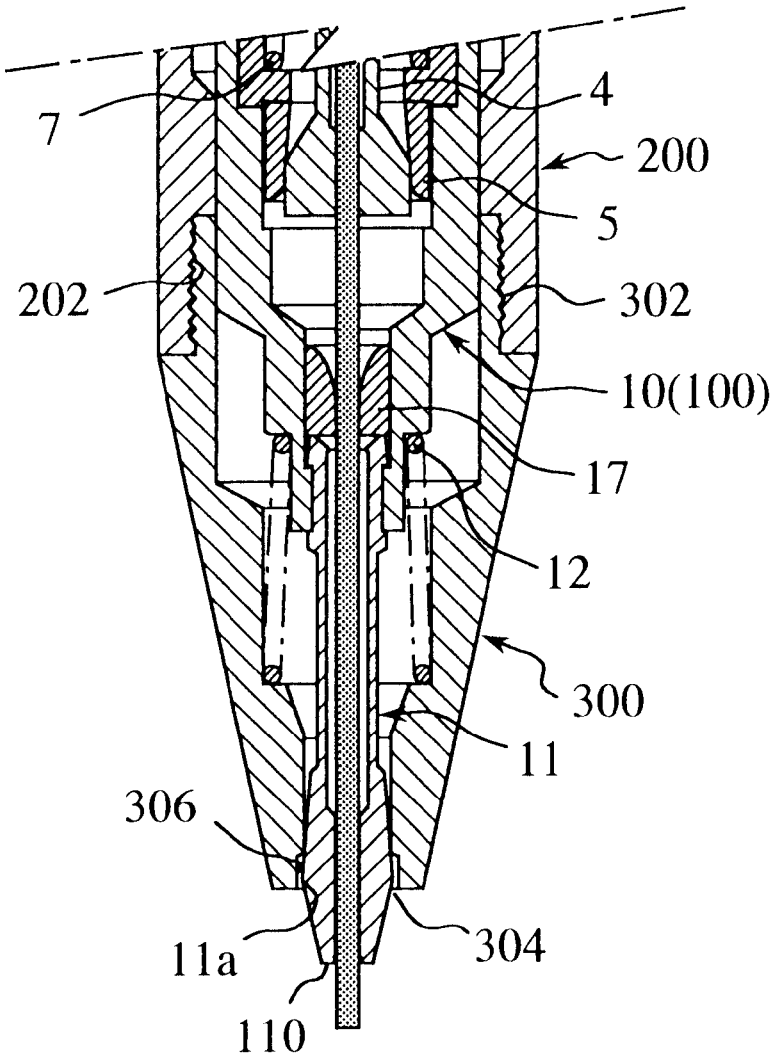
FIG. 11 is a longitudinal sectional view of an essential portion of a double-chuck mechanical pencil in a third embodiment according to the present invention.

A double-chuck mechanical pencil in a third embodiment according to the present invention will be described with reference to FIG. 11. The double-chuck mechanical pencil in the third embodiment differs from the double-chuck mechanical pencils in the first and the second embodiment in that the double-chuck mechanical pencil in the third embodiment has a barrel 1 formed by combining a barrel body 200 and a tip cap 300, and is not provided with any parts corresponding to the metal rings 13 of the first and the second embodiment.

The tip cap 300 is a metal member that can be formed in accurate dimensions as compared with synthetic resin members and the barrel body 200 is formed of a synthetic resin or a metal. A stem part of the tip cap 300 is provided with an external thread 302 and a front end part of the barrel body 200 is provided with an internal thread 202. The stem part of the tip cap 300 is screwed in the front end part of the barrel body 200 to combine the tip cap 300 with the barrel body 200. Since the tip cap 300 is formed of a metal, an open end part 304 of the tip cap 300 can be accurately formed in predetermined dimensions. The dimensions of the tip cap 300 are determined so that the angular middle portions 11*a* of the front chuck 11 is closely fitted in the open front end part 304 of the tip cap 300 to prevent the shaking of the front chuck 11. A front end portion 306 of the open front end part 304 of the tip cap 300 is formed of an increased diameter, and the angular middle portions 11*a* of the chucking head 110 of the front chuck 11 lies in the front end portion 306 of an increased inside diameter while the double-chuck mechanical pencil is being used for writing. When a lateral force acts on the chucking head 110 of the front chuck 11, the angular middle portions 11*a* come into line contact with the circumference of the bore of the open front end part 304 of the tip cap 300, thereby to prevent the front chuck from lateral shaking.

Modifications are possible in the foregoing embodiments. For example, although the third spring 9 is extended between the flange 21 of the lead tank 2 and the shoulder 81 of the stopping tube 8 (or the internal flange 806 of the stopping tube 800) to restrain the lead tank 2 from free axial movement in the foregoing embodiment, the free axial movement of the lead tank 2 can be prevented without using the third spring 9 by determining the position of the shoulder 81 (or the internal flange 806) so that the interval between the flange 21 of the lead tank 2 and the shoulder 81 of the stopping tube 8 (or the internal flange 806 of the stopping tube 800) is small.

As apparent from the foregoing description, even if the lead tank is turned by some cause, the turning of the lead tank is not transmitted to the feed chuck because the lead tank is separated from the feed chuck and is disposed behind the feed chuck. Accordingly, there is no possibility that the lead held by the front chuck and the feed chuck is twisted and broken. Since the inner tube has the elastic part capable of axial expansion and contraction, errors in the positions of the slots of the barrel and the first projections of the inner tube can be compensated for by the axial elastic deformation of the elastic part of the inner tube.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A double-chuck mechanical pencil comprising:

a barrel having an open front end part;

an inner tube inserted in the barrel;

a front chuck for chucking a tip portion of a lead;

the front chuck having a first chucking head and supported in a front end part of the inner tube with a front end part thereof projected outside through the open front end part of the barrel;

a feed chuck for advancing the lead to feed it to the front chuck;

the feed chuck having a second chucking head and inserted in the inner tube;

a chuck ring put on the second chucking head of the feed chuck; and an axially movable tank serving as both means to contain spare leads and means to push the feed chuck;

the tank disposed behind the feed chuck and separated from the feed chuck;

wherein when the tank is pushed at a rear end thereof, the feed chuck is advanced by the tank to feed the lead to the front chuck.

2. The double-chuck mechanical pencil according to claim 1 further comprising:

a first spring interposed between the barrel and the inner tube so as to bias the inner tube continuously backward;

first cooperating means on the barrel and inner tube for retaining the inner tube on the barrel against the resilience of the first spring;

a sleeve inserted in the inner tube;

the feed chuck inserted in the sleeve with the second chucking head projecting from the sleeve;

a second spring interposed between the sleeve and the feed chuck to bias the feed chuck backward;

a stopping tube disposed behind the sleeve;

the tank inserted in the stopping tube at a front end part thereof;

second cooperating means on the inner tube and the stopping tube for retaining the stopping tube on the inner tube; and a pushing member attached to the rear end of the tank.

3. The double-chuck mechanical pencil according to claim 2 wherein the first cooperating means comprises first axially extending slots formed in the barrel and first projections provided on the inner tube, the first projections being engaged with the axially extending slots, and wherein the second cooperating means comprises second slots formed in the inner tube and second projections provided on the stopping tube, the second projections being engaged with the second slots.

4. The double-chuck mechanical pencil according to claim 3, wherein the inner tube has an elastic part capable of axially expanding and contracting to adjust positions of the first projections relative to the first slots of the barrel when the respective positions of the slots and those of the corresponding first projections do not coincide.

5. The double-chuck mechanical pencil according to claims 4, further comprising a third spring interposed between the lead tank and the stopping tube, the third spring capable of exerting a resilient force lower than those exerted by the first and second springs.

6. The double-chuck mechanical pencil according to claim 3, further comprising a third spring interposed between the lead tank and the stopping tube, the third spring capable of exerting a resilient force lower than those exerted by the first and second springs.

7. The double-chuck mechanical pencil according to claim 2 further comprising a third spring interposed between the lead tank and the stopping tube, the third spring capable of exerting a resilient force lower than those exerted by the first and second springs.

8. The double-chuck mechanical pencil according to claim 2, wherein the open front end part of the barrel has a front section having an increased inside diameter, the first chucking head of the front chuck has a plurality of grasping parts each having an angular middle portion and sloping portions having sloping outer surfaces sloping down forward and backward, respectively, from the angular middle portion, and the angular middle portions of the first chucking head of the front chuck lie in the front section while the double-chuck mechanical pencil is being used for writing.

9. The double-chuck mechanical pencil according to claim 2, wherein a metal sleeve having a bore having a front section of an increased inside diameter is fitted in the open front end part of the barrel, the first chucking head of the front chuck has a plurality of grasping parts each having an angular middle portion and sloping portions having sloping outer surfaces sloping down forward and backward, respectively, from the angular middle portion, and the angular portions of the first chucking head of the front chuck lie in the front section while the double-chuck mechanical pencil is being used for writing.

10. The double-chuck mechanical pencil according to claim 2, further comprising a lead holding member interposed between the feed chuck and the front chuck in alignment with a center axis of a lead supply path.

11. The double-chuck mechanical pencil according to claim 2, wherein the barrel comprises a barrel body and a tip cap attached to a front end part of the barrel body.

12. The double-check mechanical pencil according to claim 2, wherein at least either the feed chuck or the lead tank is provided with an auxiliary pressing means for facilitating the pressing of the feed chuck.

13. The double-chuck mechanical pencil according to claim 1, wherein the open front end part of the barrel has a front section having an increased inside diameter, the first chucking head of the front chuck has a plurality of grasping parts each having an angular middle portion and sloping portions having sloping outer surfaces sloping down forward and backward, respectively, from the angular middle portion, and the angular middle portions of the first chucking head of the front chuck lie in the front section while the double-chuck mechanical pencil is being used for writing.

14. The double-chuck mechanical pencil according to claim 1, wherein a metal sleeve having a bore having a front section of an increased inside diameter is fitted in the open front end part of the barrel, the first chucking head of the front chuck has a plurality of grasping parts each having an angular middle portion and sloping portions having sloping outer surfaces sloping down forward and backward, respectively, from the angular middle portion, and the angular portions of the first chucking head of the front chuck lie in the front section while the double-chuck mechanical pencil is being used for writing.

15. The double-chuck mechanical pencil according to claim 14, wherein the metal sleeve is provided with an annular ridge, the open front end part of the barrel is provided with an annular groove, and the metal sleeve is turnably held in the barrel with the annular ridge thereof fitted in the annular groove of the barrel.

16. The double-chuck mechanical pencil according to claim 1 further comprising a lead holding member interposed between the feed chuck and the front chuck in alignment with a center axis of a lead supply path.

17. The double-chuck mechanical pencil according to claim 1, wherein the barrel comprises a barrel body and a tip cap attached to a front end part of the barrel body.

18. The double-chuck mechanical pencil according to claim 1, wherein at least either the feed chuck or the lead tank is provided with an auxiliary pressing means for facilitating the pressing of the feed chuck.

19. The double-chuck mechanical pencil according to claim 18, wherein the auxiliary pressing means is provided on a back end part of the feed chuck or on a front end part of the lead tank.

20. The double-chuck mechanical pencil according to claim 19, wherein the auxiliary pressing means comprises a flange.

* * * * *